US006097914A

United States Patent [19]

Tanaka et al.

[11] Patent Number: 6,097,914

[45] **Date of Patent: *Aug. 1, 2000**

[54] IMAGE BEARING MEMBER AND METHOD OF MANUFACTURING THE MEMBER AND IMAGE FORMING APPARATUS USING THE MEMBER

[75] Inventors: Masaru Tanaka, Yokohama; Takeo Suda; Sadao Takahashi, both of Tokyo; Takerou Kurenuma, Yokosuka; Wataru Ohtani, Sagamihara; Itaru Ohtsuka, Ebina, all of Japan

[73] Assignee: Ricoh Company, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/009,331

[22] Filed: Jan. 20, 1998

[30] Foreign Application Priority Data

| | | | |
|---|---|---|---|
| Jan. 17, 1997 | [JP] | Japan | 9-020025 |
| Mar. 21, 1997 | [JP] | Japan | 9-087750 |
| Dec. 4, 1997 | [JP] | Japan | 9-350037 |
| Dec. 4, 1997 | [JP] | Japan | 9-350038 |

[51] Int. Cl.[7] ..... G03G 15/00

[52] U.S. Cl. ..... 399/159

[58] Field of Search ..... 399/111, 116, 399/117, 159

[56] References Cited

U.S. PATENT DOCUMENTS

| | | | |
|---|---|---|---|
| 4,791,464 | 12/1988 | Ipri et al. | 357/23.7 |
| 5,652,077 | 7/1997 | Obinata | 399/159 X |
| 5,678,125 | 10/1997 | Kutsuwada et al. | 399/26 |
| 5,771,425 | 6/1998 | Yamada et al. | 399/111 |

FOREIGN PATENT DOCUMENTS

| | | |
|---|---|---|
| 1-173765 | 12/1989 | Japan . |
| 2-302482 | 12/1990 | Japan . |
| 3-217888 | 9/1991 | Japan . |
| 4-84182 | 3/1992 | Japan . |
| 5-35166 | 2/1993 | Japan . |
| 5-35167 | 2/1993 | Japan . |
| 6-282204 | 10/1994 | Japan . |
| 2506859 | 5/1996 | Japan . |
| 8-146637 | 6/1996 | Japan . |
| 8-227250 | 9/1996 | Japan . |
| 9-62143 | 3/1997 | Japan . |
| 9-90814 | 4/1997 | Japan . |

*Primary Examiner*—Fred L. Braun

*Attorney, Agent, or Firm*—Oblon, Spivak, McClelland, Maier & Neustadt, P.C.

[57] ABSTRACT

An image bearing member utilized in an image forming apparatus includes a cylindrical member on which an image is formed on a peripheral surface thereof. An image bearing member further includes a filling-up member which suppresses vibration of the cylindrical member by being inserted into an inner part of the cylindrical member, and an anaerobic adhesive which adheres and fixes an outer peripheral surface of the filling-up member to an inner peripheral surface of the cylindrical member by osmosing into a clearance formed between the inner peripheral surface of the cylindrical member and the outer peripheral surface of the filling-up member. The anaerobic adhesive is placed inside of an end face of at least one side of the outer peripheral surface of the filling-up member, and an adhesion width is formed wherein the anaerobic adhesive is spread around an entire periphery of the outer peripheral surface of the filling-up member from an end face of the filling-up member. The adhesive can be hardened by use of ultraviolet rays or a lid. Furthermore, gas can be sealed in the inner part of the cylindrical member. A method for manufacturing an image bearing member for an image forming apparatus includes vertically positioning a filling-up member inside a cylindrical member, injecting an anaerobic adhesive between the filling-up member and the cylindrical member, and hardening the anaerobic adhesive after the anaerobic adhesive has osmosed into the clearance between the cylindrical member and the filling-up member.

26 Claims, 6 Drawing Sheets

SUPPORTING PROCESS

ANAEROBIC GLUE OSMOSING PROCESS

ADHERING PROCESS

VISCOSITY(cp) OF ANAEROBIC GLUE 3

IMAGE BEARING MEMBER AND METHOD OF MANUFACTURING THE MEMBER AND IMAGE FORMING APPARATUS USING THE MEMBER

BACKGROUND OF THE INVENTION

1. Field of the Invention

The present invention relates to an image bearing member and a manufacturing method therefor and an image forming apparatus which uses the image bearing member, and in particular, to an image bearing member having a filling-up member fixed to the cylindrical member thereof which is used, for example, in a copying machine, a printer, a facsimile machine, a multi-functional machine thereof and the like, to a manufacturing method thereof, and to an image forming apparatus using the image bearing member.

2. Discussion of the Background

A drum-shaped image bearing member which is used for an electrophotographic image forming apparatus is composed of a hollow cylindrical member of which a photosensitive layer, conductive layer and the like are coated on the outer peripheral surface of the cylindrical member.

In an electrophotographic image forming apparatus, an image is formed by transferring a toner image to a transfer sheet and fixing that on the transfer sheet after forming an electrostatic latent image on the image bearing member as a photoconductive element, and developing the toner image. Various methods of manufacturing a cylindrical photoconductive drum, namely, an image bearing member have been conventionally proposed.

For example, in a case of obtaining a construction for supporting both ends of opening portion of the cylindrical member by inserting a flange into an inner peripheral surface of the hollow cylindrical member as an image bearing member and fixing that thereto, fitting art is known in which adhesive having a quick hardening ability and an elasticity after complete hardening is applied onto an inner peripheral surface of the cylindrical member or an external peripheral surface of the flange. See Japanese Laid-open Patent Publication No. 6-282204/1994. There, the flange is press fit onto the inner peripheral surface of the hollow cylindrical member employed as the image bearing member, and thereafter both elements are combined with adhesive, and thereby a structure of supporting the both-ends releasing portions of the above cylindrical member can be obtained. On that occasion, grooves are provided adjacently to the both sides of the adhesion part. In such structure, when the flange is fixed so as to press fit in the cylindrical member, excess adhesive applied to the adhesion part is intercepted by the grooves thus provided adjacent thereto. Consequently, the excess adhesive flowing out from the adhesion part can be prevented from adhering on the image bearing member, etc. at the time of inserting the adhesive or using the apparatus. Such related art as mentioned above is well known. See Japanese Laid-open Patent Publication No. 4-84182/1992.

However, there has been a shortcoming that, in a case of applying the image bearing member having aforementioned construction to an electrophotographic copying machine, in which electrophotographic method is used, performance deteriorates due to occurring of noise by trembling a cleaning blade which rubs with the surface of the image bearing member when performing a charging operation, driving the image bearing member or the like, and stopping an image forming operation, if the image forming operation is performed in an image forming process including a process of charging by contacting a charging member in which voltage is applied thereof with the image bearing member.

To solve such a shortcoming, a related art of suppressing the occurrence of noise due to vibration of the image bearing member when charging, by mounting a weight member inside the image bearing member press fit via an elastic member between the inner peripheral surface of the image bearing member and the outer peripheral surface of the weight member, is known. See Japanese Laid-Open Patent Publication No. 5-35166/1993.

However, in such an image bearing member, and a manufacturing method thereof and an image forming apparatus which uses the image bearing member, it is difficult to press fit the weight into the image bearing member although it is required to press fit via the elastic member having a hardness of 20 degrees through 70 degrees JIS (Japanese Industrial Standard). Especially in the case of manufacturing the image bearing member using thin material, a variation from swelling is caused with inner pressure due to press fitting operation of the elastic member. Further, if such an image bearing member is used for an image forming apparatus, the manufacturing cost is increased and it is also difficult to obtain a high quality image.

In addition, suppressing noise which occurs due to vibration of the image bearing member by adhering a filling-up member having a slight taper at a side to an inside of the image bearing member by first applying an epoxy resin adhesive onto an inner peripheral surface of the image bearing member then inserting the filling-up member, or after applying the epoxy resin adhesive onto an outer peripheral surface of a filling-up member made of a rigid body or an elastic member, inserting the filling-up member into an inside of the cylindrical image bearing member is known. See Japanese Laid-Open Patent Publication No. 5-35167/1993 and Japanese Laid-Open Patent Publication No. 8-146637/1996.

However, in the related art, applying epoxy resin adhesive onto an inner peripheral surface of the image bearing member, or onto an outer peripheral surface of a filling-up member is difficult, and there has been a shortcoming that an inferior product is made due to adhering or scattering of the excess adhesive to both end faces of the filling-up member or the image bearing member when inserting the filling-up member. Furthermore, it has also been difficult to press fit the filling-up member into the inside part of the image bearing member via the adhesive.

In particular, it takes a relatively long time to insert and fix the filling-up member with the epoxy resin adhesive or the like, and the image bearing member made of a thin material is deformed, therefor resulting in an inferior product because of variation due to swelling from the inner pressure caused by press fitting the filling-up member. Namely, in a case of using such an image bearing member as an image forming apparatus, it takes from 30 minutes to several hours for adhering the filling-up member to the image bearing member with an epoxy resin or epoxy two-liquid adhesive agent, and further, even a 5-minutes-hardening-type two-liquid adhesive takes 5 minutes for starting hardening from liquid state, and further, it takes from 30 minutes to several hours for reaching an actual hard state. Therefore, it requires high costs and is also difficult to obtain a high quality images. In a case of an image bearing member made of thin material, the shape of image bearing member can swell or otherwise deform due to the inner pressure caused by inserting the filling-up member into the image bearing member. If such image bearing member is used for the image forming apparatus, the manufacturing costs of the apparatus are increased due to the long curing time required, and it is more difficult to obtain a high image quality due to the deformations.

SUMMARY OF THE INVENTION

In view of the above-mentioned consideration, it is an object of the present invention to provide an image bearing member capable of suppressing vibration by containing a filling-up member inside thereof.

According to an aspect of the present invention, an image bearing member utilized in an image forming apparatus, includes a cylindrical member on which an image is formed on a peripheral surface thereof.

An image bearing member further includes a filling-up member which suppresses vibration of the cylindrical member by being inserted into an inner part of the cylindrical member, and an anaerobic adhesive which adheres and fixes an outer peripheral surface of the filling-up member to an inner peripheral surface of the cylindrical member by osmosing (or diffusing by osmosis) into a clearance formed between the inner peripheral surface of the cylindrical member and the outer peripheral surface of the filling-up member.

The anaerobic adhesive is placed inside of an end face of the outer peripheral surface of the filling-up member, and an adhesion width is formed wherein the anaerobic adhesive is spread around an entire periphery of the outer peripheral surface of the filling-up member.

A method of manufacturing the image bearing member in which said filling-up member is fixed to the cylindrical member is provided.

The method includes a supporting step where the filling-up member is supported so as to stand up perpendicularly to a pedestal inside said cylindrical member standing which is also standing up perpendicularly to the pedestal, and forming the predetermined clearance between the inner peripheral surface of said cylindrical member and the outer peripheral surface of the filling-up member.

The method further includes an injecting step where the anaerobic adhesive is injected into the clearance formed between the filling-up member and the cylindrical member.

The method also includes an osmosing step where the anaerobic adhesive is osmosed and dropped into the clearance and forms an adhesion width wherein anaerobic adhesive is spread around an entire periphery of the outer peripheral surface of the filling-up member.

The method further includes an adhering step of the cylindrical member and the filling-up member with the anaerobic adhesive so as to be fixed to each other.

BRIEF DESCRIPTION OF THE DRAWINGS

A more complete appreciation of the invention and the attendant advantages thereof will be readily obtained by referring to the following detailed description when considered in connection with the accompanying drawings, wherein.

DESCRIPTION OF THE PREFERRED EMBODIMENT

Figure 1:
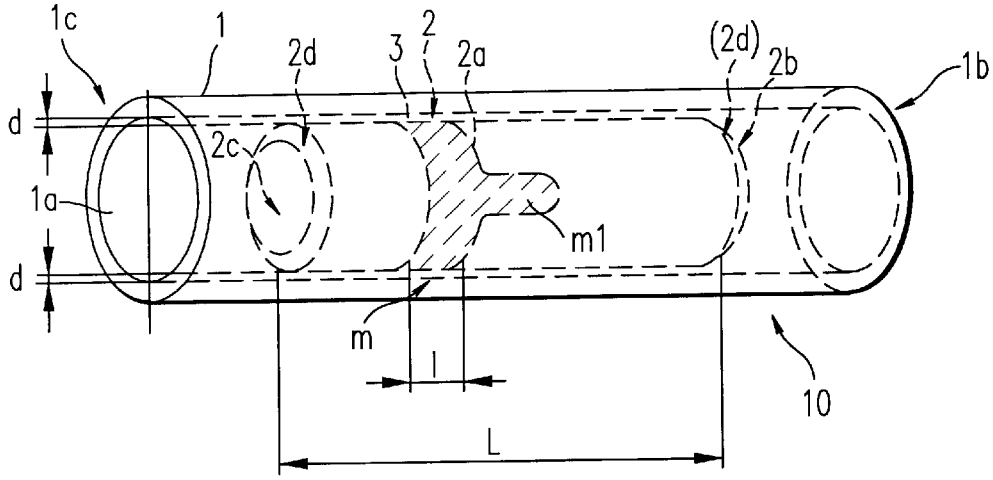
FIG. 1 is a perspective view explaining an image bearing member of an example of the present invention.

An embodiment of the present invention will be explained, hereinafter, referring to the drawings.

Figure 2:
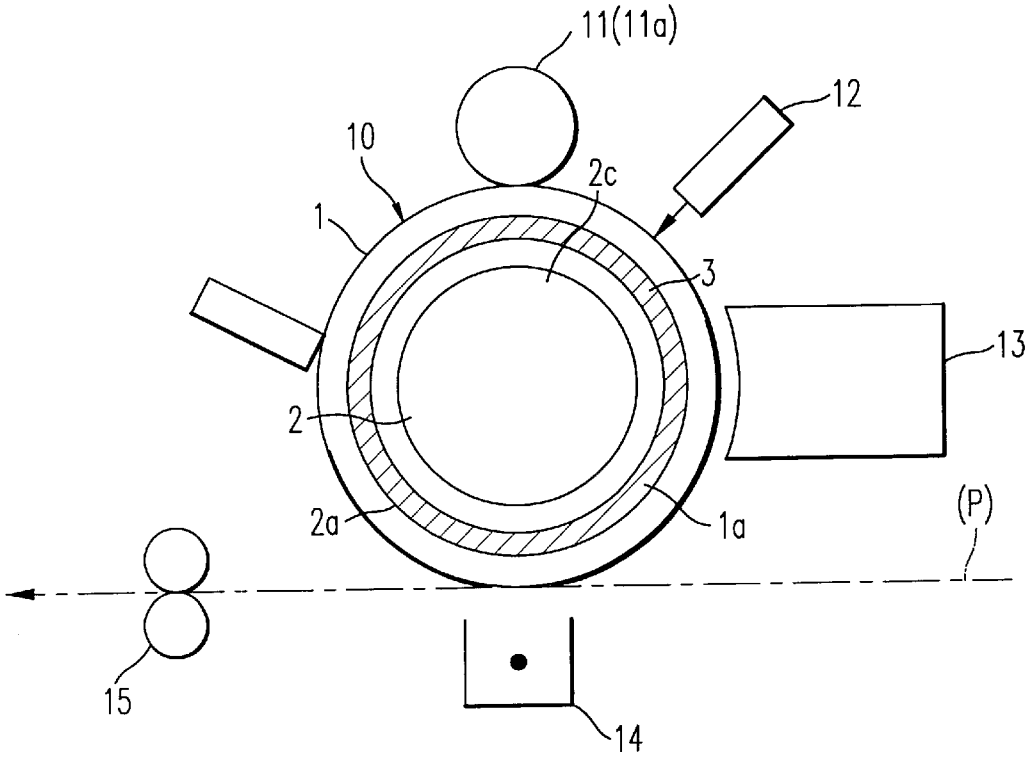
FIG. 2 is a schematic illustration explaining an image forming apparatus in which the image bearing member shown in FIG. 1 is used.
Figure 3:
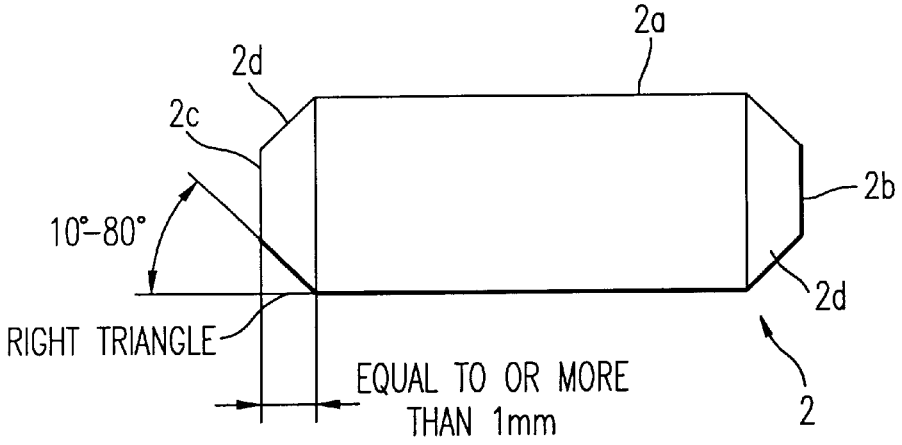
FIG. 3 is an elevation of the image bearing member shown in FIG. 1.

FIG. 1 is a perspective illustration of the outer view of an image bearing member of the present invention, FIG. 3 is an elevation of a filling-up member, and FIG. 2 is an elevation of an image forming part of the image bearing member. An image bearing member 10 is used for image forming processes of charging, exposing, developing, and transferring in an image forming apparatus as a copying machine or the like using an electrophotographic method. In addition, image bearing member 10 includes cylindrical member 1 which receives an image on an outer peripheral surface thereof, filling-up member 2 which is inserted into an inner part of cylindrical member 1, inclining surface 2*d* which has a tapered shape from outer peripheral surface 2*a* of filling-up member 2 towards end face 2*b*, inclining surface 2*d* formed between surface 2*a* and 2*c*, where surface 2*d* is formed in a continuous or stepwise shaped taper having an inclining angle of 10 to 80 degrees. In addition, inclining surface 2*d* of filling-up member 2 may be any shape of gradually decreasing diameter such as the shape having stepwise difference in decreasing diameter, the shape of curved taper, waving tapered surface, or the like. A clearance d is formed between inner peripheral surface 1*a* of cylindrical member 1 and outer peripheral surface 2*a* of filling-up member 2. Image bearing member 10 is made by adhering and fixing outer peripheral surface 2*a* of filling-up member 2 to inner peripheral surface 1*a* of cylindrical member 1 by injecting and osmosing anaerobic adhesive 3 into clearance d formed between inner peripheral surface 1*a* of cylindrical member 1 and outer peripheral surface 2*a* of filling-up member 2, where clearance d between 50 $\mu$m to 250 $\mu$m.

Cylindrical member 1 can be, for example, made of a thin hollow cylindrical aluminum member having an outer diameter of 30 mm, a length of 340 mm, and a thickness of 0.75 mm, coated with a conductive layer and photosensitive layer at an outer peripheral surface thereof, so as to be used for image forming process of the image forming apparatus, being movably positioned with a supporting member (not shown).

Filling-up member 2 can be, for example, a cylindrically shaped member which is made of aluminum or brass, where the material is appropriately selected in consideration of the length, weight, cost, or the like. Filling-up member 2 is a weight member which suppresses the vibration of the image forming apparatus, and is fixed to the inside of cylindrical member 1 at a position between end face opening 1*b* of a first side of the longitudinal direction thereof and end face opening 1*c* of a second side thereof. As stated above, inclining surface 2*d* of filling-up member 2 has a taper whose inclination angle is 10 to 80 degrees, and the length is equal to or longer than 1 mm as shown in FIG. 3. In other words, the inclining surface 2*d* is formed, for example, by cutting off the corner of the filling-up member 2 such that the width of surface 2*d* measured along a radius of surface 2*c* or 2*b*, and the length of the surface measured along the longitudinal axis of member 2 are equal to or longer than 1 mm, at an entire periphery (in FIG. 3). The inclining surface 2*d* is uniformly formed at the corner of the filling-up member 2 around the entire periphery thereof, and accordingly the end part of the filling-up member 2 has a shape of truncated cone. The merits of forming the inclining surface 2*d* are that the filling-up member 2 can easily be inserted to the inner part of cylindrical member 1, and anaerobic adhesive 3 can be easily injected into the aforementioned clearance, as described later.

A hardening time required for anaerobic adhesive 3 is short, namely, equal to or less than one minute. The usable zone of viscosity thereof is from 10 cp through 400 cp, and preferably, a material of viscosity from 100 cp through 200 cp is used as anaerobic adhesive 3. Further, the adhesive is required to have good osmosis. The 1303N (brand name) made by Three-bond Co., Ltd. or 290 (brand name) made by Lock-tight C., Ltd., which are both on the market, can be used.

Anaerobic adhesive 3 forms adhesion surface m in which the anaerobic adhesive 3 is osmosed around outer peripheral surface 2*a* of filling-up member 2, between end face 2*b* and end face 2*c* of filling-up member 2. That is, anaerobic adhesive 3 is spread as an adhesion surface m having a predetermined adhesion width l which extends around the entire peripheral surface of filling-up member 2, in a longitudinal direction between end face 2*b* and end face 2*c*. Mark m1 is an extended portion in which the adhesion surface (m) is extended towards the longitudinal direction. The adhesion surface which extends around the entire peripheral surface of the filling-up member is hereinafter called "entire periphery spread area". As shown in a manufacturing procedure, described later, end face 2*c* of filling-up member 2 is one side for injecting the adhesive, and the characterized feature of the present invention is that the adhesive 3 which is injected into the clearance d from the end face 2*c* is osmosed and hardened before reaching end face 2*b*. Consequently, the shortcomings of the related art in which the adhesive adheres or scatters to the image bearing member other than the adhesion surface of the filling-up member, for example, an end face of the filling-up member, the cylindrical member or the like, can be eliminated.

In FIG. 2, image bearing member 10 which is fixed by adhering inner peripheral surface 1*a* of cylindrical member 1 and outer peripheral surface 2*a* of filling-up member 2 with anaerobic adhesive 3 is charged by charging roller 11*a* as a contact charging device 11. An electrostatic latent image is formed by exposing the outer peripheral surface of the charged image bearing member 10, by exposing device 12, and the electrostatic latent image is developed with developing device 13. The developed toner image is then transferred onto recording sheet P with transferring device 14, and fixed with fixing device 15 in order to form an image. Further, the aforementioned charging roller may be employed, even though a usual corona charger or the like is also applicable for the charging device.

Figure 4:
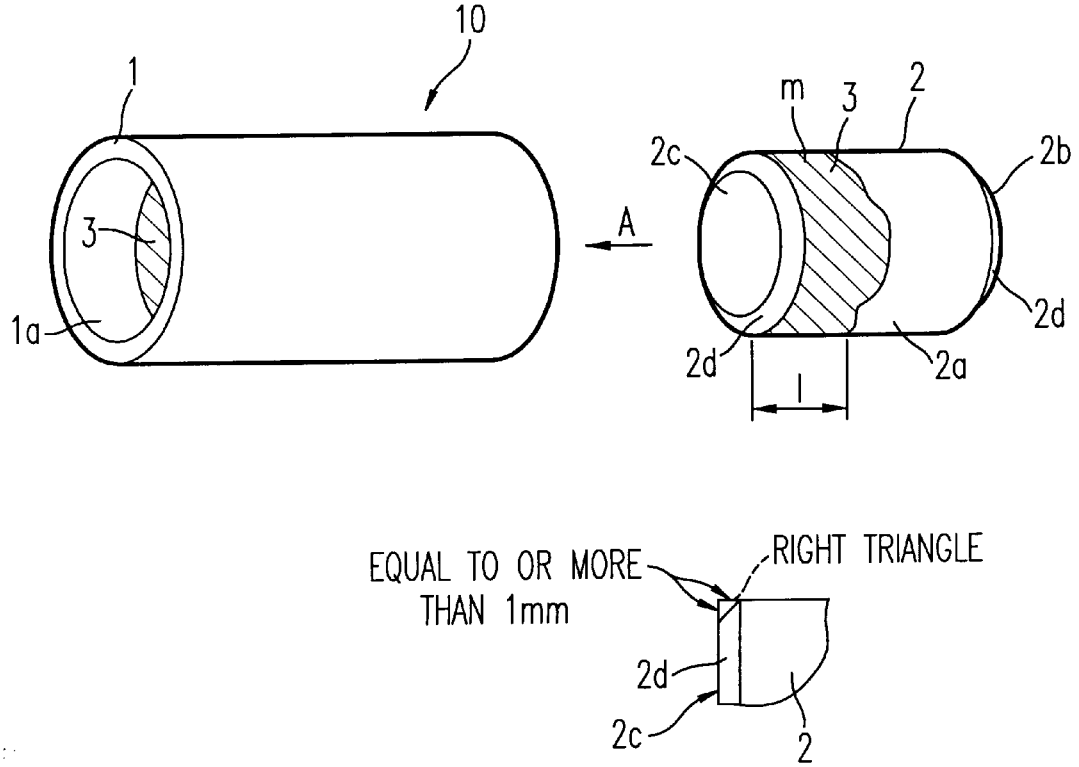
FIG. 4 is an illustration explaining an example of a manufacturing method of the image bearing member in the present invention.

FIG. 4 is a perspective view showing an example of the method for inserting and fixing filling-up member 2 to the inner part of the cylindrical member 1. Image bearing member 10 having a hollow cylindrical shape with a hole penetrating through the longitudinal direction is assembled with filling-up member 2 by inserting filling-up member 2 in a direction indicated by an arrow A after first applying anaerobic adhesive 3 onto inner peripheral surface 1*a* of cylindrical member 1 or outer peripheral surface 2*a* of filling-up member 2. Image bearing member 10 can be manufactured by the method of fixing the aforementioned filling-up member 2 to the inner part to the aforementioned cylindrical member 1 by forming adhesion width l and adhesion surface m in which anaerobic adhesive 3 is spread around the entire peripheral surface of the aforementioned outer peripheral surface 2*a* between end face 2*c* and end face 2*b*.

However, if filling-up member 2 is assembled with image bearing member 10 by such a method, anaerobic adhesive 3 tends to adhere onto end face 2*b* of filling-up member 2, end face 2*c*, inner peripheral surface 1*a* of cylindrical member 1, or the like, and accordingly anaerobic adhesive 3 is required to be removed. Further, excess un-hardened anaerobic adhesive 3 is also likely to drop down or scatter onto end face 2*b*, end face 2*c* or onto inner peripheral surface 1*a* of cylindrical member 1. These unhardened portions of anaerobic adhesive 3 causes shortcomings such as a deterioration of an image quality or the like.

Figure 5A:
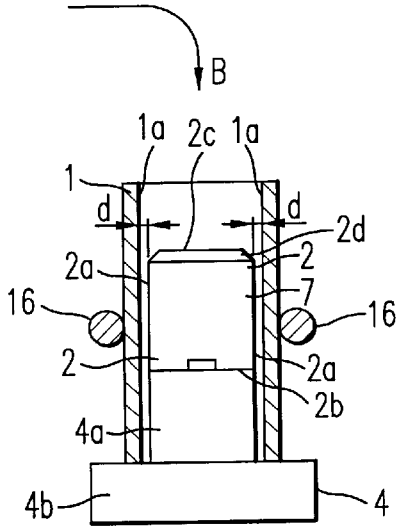
FIGS. 5(*a*) through 5(*c*) are illustrations explaining a manufacturing method of the image bearing member of an embodiment of the present invention.
Figure 5B:
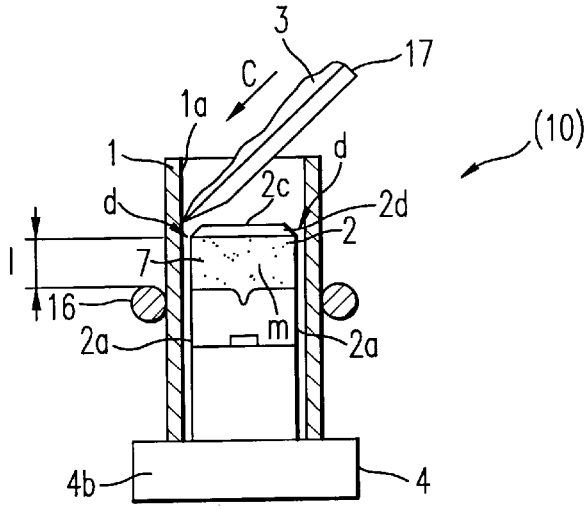
Figure 5C:
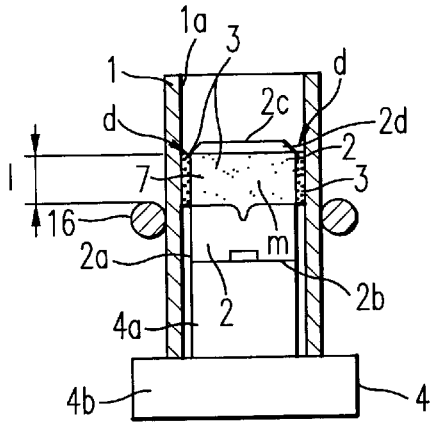

FIGS. 5(*a*) through 5(*c*) are illustrations showing an example of the manufacturing procedure in the present invention. FIG. 5(*a*) illustrates a supporting step of the manufacturing method of the aforementioned image bearing member 10 to fix the filling-up member 2 to the cylindrical member 1 at the predetermined adhesion width (l) and adhesion surface (m) in which the anaerobic adhesive 3 is placed inside the end face 2*b* of at least one side of the filling-up member 2. In the supporting step shown in FIG. 5(*a*), filling-up member 2 is supported, in a perpendicular posture such that the end having inclined surface 2*d* is facing upwards, where filling-up member 2 rests on the top face of supporting member 4 which has a convex shape in cross section, and then cylindrical member 1 is moved in a direction indicated by arrow B by moving member 16 so that cylindrical member 1 is fitted around outer peripheral surface 2*a* of filling-up member 2. During the process of this movement, inner peripheral surface 1*a* of cylindrical member 1 is fit with filling-up member 2 by being guided with a guiding part 4*a* of the supporting member 4, and when a lower end edge of the cylindrical member 1 reaches an upper face of flange part 4*b* of supporting member 4, cylindrical member 1 stands in a perpendicular posture, keeping the predetermined clearance d with the outer peripheral surface of the filling-up member 2 which is supported on the supporting member 4. The length of the guiding part 4*a* in a longitudinal direction is predetermined so that the filling-up member 2 is positioned at the middle part of the length of a longitudinal direction of the cylindrical member 1.

Next, the injecting and osmosing steps of the adhesive in FIG. 5(*b*) includes injecting anaerobic adhesive 3 into clearance d which has a dimension between 50 $\mu$m through 2500 $\mu$m formed between the inner peripheral surface 1*a* of the cylindrical member 1 and the outer peripheral surface 2*a* of the filling-up member 2, where adhesive 3 is injected in a direction indicated by arrow C. At end face 2*c* of filling-up member 2, inclining surface 2*d* is formed and accordingly, when anaerobic adhesive 3 is injected from the direction indicated by arrow C in the figure, the excess anaerobic adhesive 3 is prevented from adhering or scattering onto cylindrical member 10 other than adhesion surface m of cylindrical member 1 and filling-up member 2. Further, not only is anaerobic adhesive 3 easy to inject or osmose, but also spreading around the peripheral direction is effectively performed by the existence of the wide clearance. During the osmosing step, anaerobic adhesive 3 forms the adhesion surface m by being spread around the entire periphery of the outer peripheral surface 2*a* over the adhesion width l by dropping down and osmosing into the clearance due to an osmosing pressure, and stops dropping down before reaching end face 2*b*.

In the adhering step shown in FIG. 5(*c*), anaerobic adhesive 3 is hardened in no more than one minute after dropping down and osmosing into clearance d, and stops dropping and osmosing before reaching the end face 2*b* of one side of the filling-up member 2. Consequently, cylindrical member 1 and filling-up member 2 are adhered and fixed with anaerobic adhesive 3.

Further, the time for hardening of anaerobic adhesive 3 can further be shortened by applying hardening agent 7, which promotes hardening of the anaerobic adhesive, onto inner peripheral surface 1*a* of cylindrical member 1 or outer peripheral surface 2*a* of filling-up member 2 which is inserted to the inner part of the cylindrical member 1, before osmosing anaerobic adhesive 3 into the clearance d. Hardening agent 7 can also be used for image bearing members, manufacturing methods, and image forming apparatuses in the below-mentioned embodiments.

Furthermore, the image bearing member obtained by the method illustrated in FIGS. 5(*a*) through 5(*c*) is included in the area of the present invention. This is applicable to the image forming apparatus using the image bearing member obtained by all the below-mentioned embodiments.

Figure 6B:
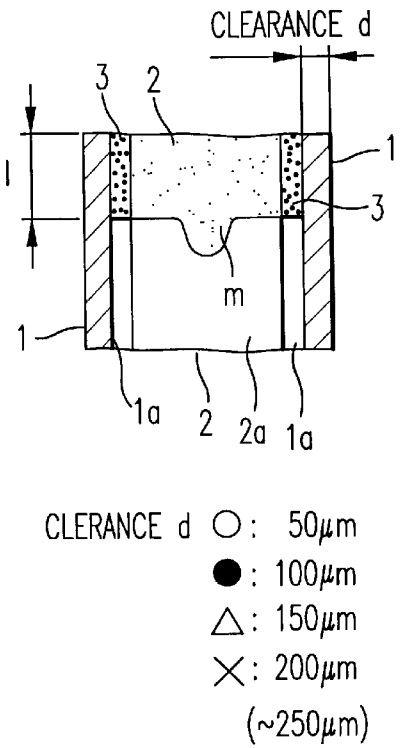
FIG. 6 is an illustration showing the effect the adherance of an anaerobic adhesive as a function of a clearance formed between an inner peripheral surface of the image bearing member and an outer peripheral surface of a filling-up member, and the viscosity of the anaerobic adhesive.
Figure 6A:
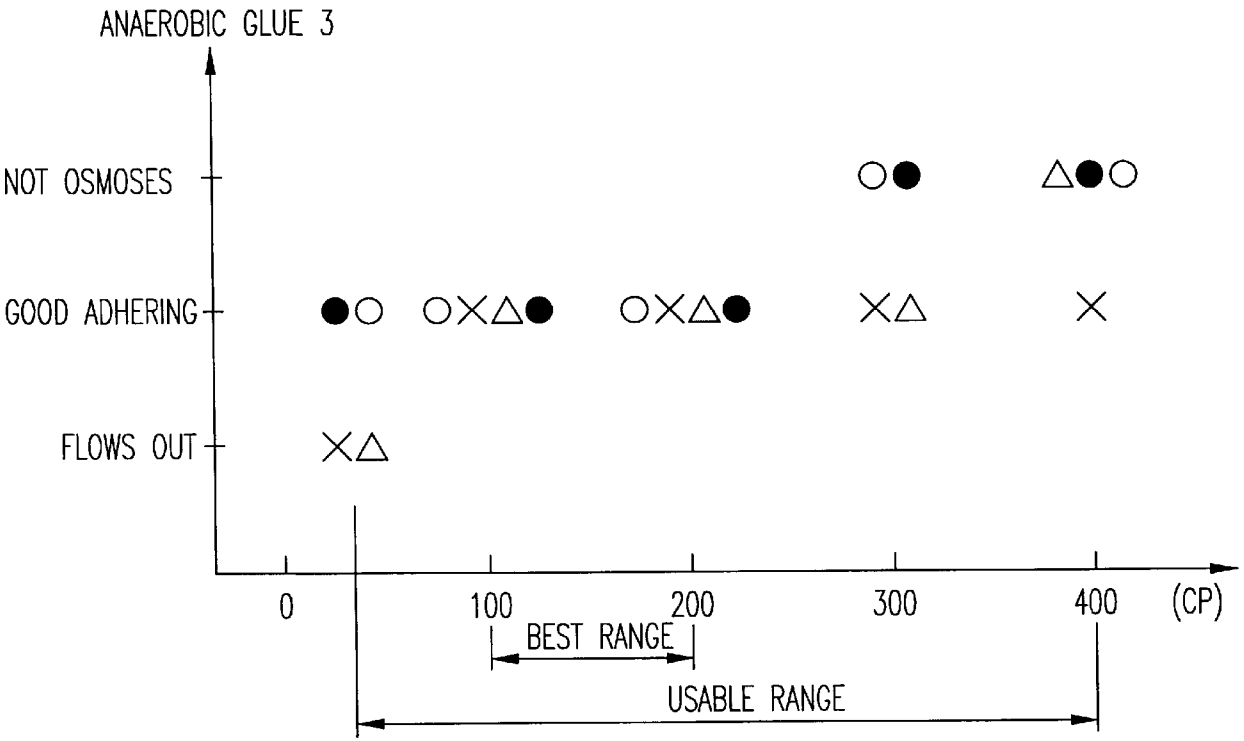

Next, FIG. 6 is a graph showing a relationship between the clearance formed between the inner peripheral surface of the cylindrical member and the outer peripheral surface of the filling-up member and the viscosity of the anaerobic adhesive. In the osmosing step of the anaerobic adhesive shown in FIG. 5(*b*), if the clearance d, (which is equal to the inner diameter of the inner peripheral surface 1*a* of the cylindrical member 1—the outer diameter of the outer peripheral surface 2*a* of the filling-up member 2 divided by 2) is too wide, and the viscosity of the anaerobic adhesive 3 is too low, the anaerobic adhesive 3 osmoses too quickly through the clearance and flows out down over the end face 2*b* of filling-up member 2, and tends to adhere onto the end face 2*b* thereof. Therefore, a shortcoming is created in which removing the excess anaerobic adhesive 3 is required, or preventing the drop or scattering of the excess anaerobic adhesive adhered onto the end face 2*b* of the one side of the filling-up member 2 or the inner peripheral surface 1*a* of the cylindrical member 1 is required.

On the contrary, if clearance d is too narrow and the viscosity of anaerobic adhesive 3 is too high, it becomes impossible to adhere and fix filling-up member 2 onto cylindrical member 1 with anaerobic adhesive 3. This is because anaerobic adhesive 3 becomes unable to be spread and osmosed around the entire periphery of outer peripheral surface 2*a* of filling-up member 2.

Therefore, for the purpose of obtaining a preferable adhering state by forming adhesion surface m of the adhesion width l in which anaerobic adhesive 3 is spread around the entire periphery of outer peripheral surface 2*a* of filling-up member 2 by osmosing around and dropping through the clearance with pressure, it is preferable to use anaerobic adhesive 3 having a viscosity of 10 cp through 400 cp which is within a useable range to the clearance of 50 $\mu$m through 200 $\mu$m. Preferably, the viscosity of anaerobic adhesive 3 is between 100 cp and 200 cp.

Preferably, the osmosing step includes injecting anaerobic adhesive 3 with a viscosity between 10 cp and 100 cp into clearance d of 50 $\mu$m through 100 m, or injecting anaerobic adhesive 3 with a viscosity between 200 cp and 300 cp into clearance d of 150 $\mu$m through 200 $\mu$m, or further, injecting anaerobic adhesive 3 with a viscosity between 300 cp and 400 cp into clearance d of 200 $\mu$m through 250 $\mu$m. Under these conditions, it has been found that a preferable adhering state has been realized by forming adhesion surface m of adhesion width l in which anaerobic adhesive 3 drops through the clearance, osmosing with pressure, and spreads around the entire periphery of outer peripheral surface 2*a* of filling-up member 2. Further, the relationship between the aforementioned measure of clearance d and the viscosity of the anaerobic adhesive is applicable not only to the embodiment in FIGS. 5(*a*) through 5(*c*) but also to that in FIGS. 7, 8, and 9.

Figure 7:
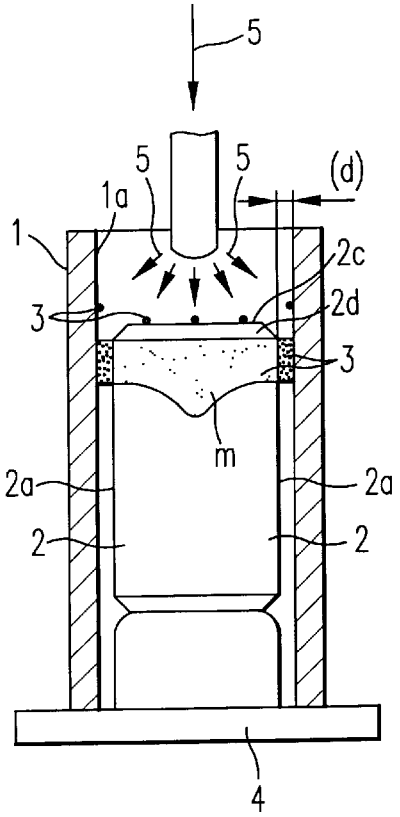
FIG. 7 is an illustration explaining another manufacturing method of the image bearing member of an embodiment of the present invention.

Next, FIG. 7 illustrates another embodiment of the present invention. In this embodiment, any excess anaerobic adhesive which does not osmose into the aforementioned clearance d and which is adhered onto the end face 2*c* or the like is hardened by isolating the excess adhesive from the air by sealing nitrogen gas 5 in the inner part of the cylindrical member 1, after osmosing the anaerobic adhesive 3 into the clearance d. Consequently, the need to remove the excess unhardened anaerobic adhesive 3 adhered onto the end face 2*c* or the like is eliminated, and the dropping and scattering of the excess anaerobic adhesive 3 which is adhered onto end face 2*c* or inner peripheral surface 1*a* can be prevented. It is preferable that the adhesive 3 adhered onto the end face is hardened without being removed because the unhardened adhesive 3 causes a deterioration of the image quality by adhering onto the surface of the photoconductive element, if the image bearing member with unhardened adhesive 3 remaining on the end face is assembled into a machine such as an image forming apparatus. Therefore, air discharging and hardening of the adhesive on the end face is promoted by sealing the nitrogen gas 5 after injection into a space between the cylindrical member 1 and the end face 2*c* in this embodiment.

Furthermore, the image bearing member obtained by the method in FIG. 7, and the electrophotographic image forming apparatus using the image bearing member is included in the present invention.

Figure 8:
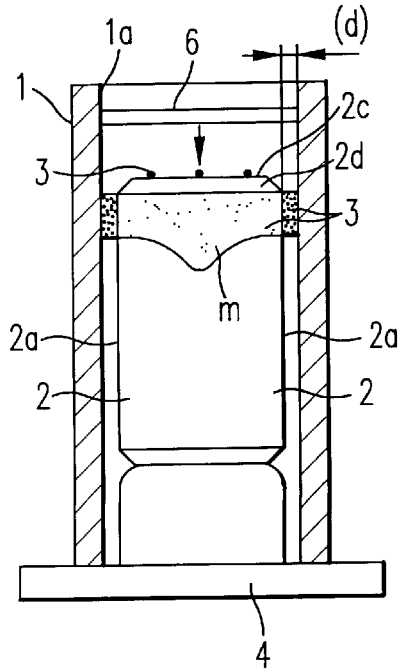
FIG. 8 is an illustration explaining still another manufacturing method of the image bearing member of an embodiment of the present invention.

FIG. 8 illustrates another embodiment of the present invention. In this embodiment, anaerobic adhesive 3 which has overflowed out of the clearance d, onto the end face 2*c* is compulsorily led back toward the clearance d by being pressed and spread with lid 6 of a flat-plate shape, made of a material whose surface has releasability, or where the overflowed adhesive is promoted to be hardened by eliminating aeration with the lid 6, after osmosing the anaerobic adhesive 3 into the clearance d. Lid 6, for example, can be an aluminum disk, or a disk having a good releasability coated with a substance including a fluorine-containing compound or a fluorine-containing substance which makes it easy to insert to or detach from the hardened anaerobic adhesive. Further, since lid 6 is free from being adhered with the anaerobic adhesive 3, the lid 6 is capable of recycling use and manufacturing costs are saved. Thus, in this embodiment, the anaerobic adhesive 3 adhered onto the end face 2*c* or the like, which is not osmosed into the clearance d is hardened by isolating from the air, and therefore, the time-consuming work of removing the excess anaerobic adhesive 3 adhered onto end face 2*c* or the like, and the dropping and scattering of the excess anaerobic adhesive 3 adhered onto end face 2*c* or inner peripheral surface 1*a* of the cylindrical member 1 can be avoided.

Furthermore, the image bearing member which is obtained by the method in FIG. 8, and the electrophotographic image forming apparatus utilizing the image bearing member is included in the present invention.

Figure 9:
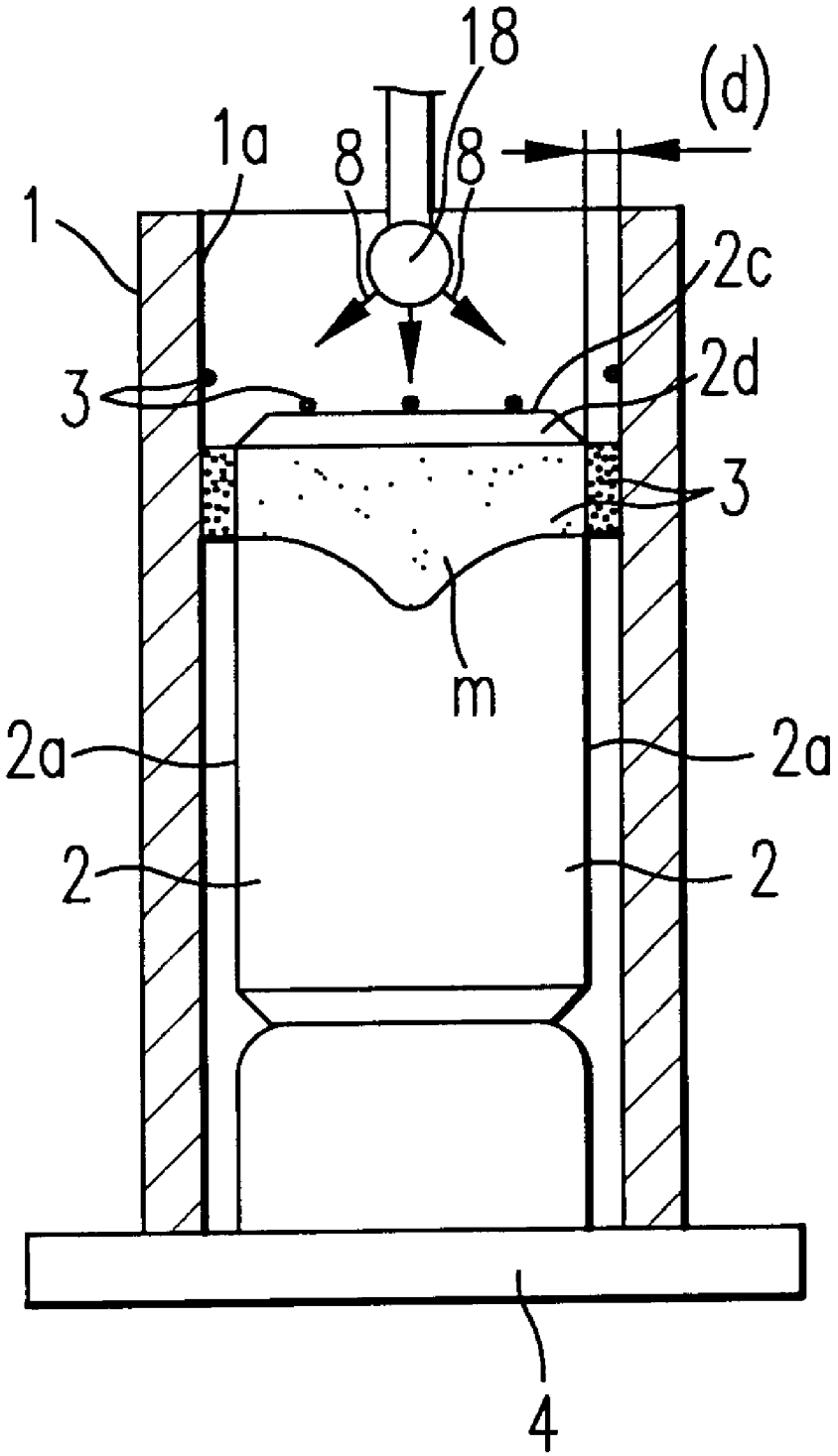
FIG. 9 is an illustration explaining a further manufacturing method of the image bearing member of an embodiment of the present invention.

FIG. 9 illustrates a further embodiment of the present invention. This embodiment is characterized by that, after osmosing anaerobic adhesive 3 which has an ultraviolet-ray hardening ability, an ultraviolet-ray 8 is radiated to the excess anaerobic adhesive 3 which has overflowed onto end face 2*c,* via an ultraviolet-ray radiating device 18. Since the anaerobic adhesive 3 adhered onto end face 2*c* of filling-up member 2 or the like, which is not osmosed into clearance d can thus be hardened, the removing work of the excess anaerobic adhesive 3 adhered onto end face 2*c* of filling-up member 2 or the like, and the dropping and scattering of the excess anaerobic adhesive 3 which is adhered onto end face 2*c* of filling-up member 2 or inner peripheral surface 1*a* of cylindrical member 1 can be prevented.

Further, the image bearing member obtained by the method in FIG. 9, and the electrophotographic image forming apparatus utilizing this image bearing member is included in the present invention.

What is claimed as new and desired to be secured by Letters Patent of the United States is:

1. An image bearing member utilized in an image forming apparatus comprising:

a cylindrical member, on a peripheral surface of which an image is to be formed;

a filling-up member mounted with a clearance to an inner part of said cylindrical member for suppressing vibration of said cylindrical member; and, an anaerobic adhesive which adheres to and fixes an outer peripheral surface of said filling-up member to an inner peripheral surface of said cylindrical member, wherein said clearance is configured such that adhesive is able to diffuse into clearance through osmosis, wherein said clearance formed between said inner peripheral surface of said cylindrical member and said outer peripheral surface of said filling-up member is between 50 $\mu$m and 200 $\mu$m, and wherein a viscosity of said anaerobic adhesive is between 10 cp and 400 cp.

2. The image bearing member according to claim 1, wherein said filling-up member is fixed to a middle portion along a longitudinal direction of said cylindrical member between a first and second end of said cylindrical member.

3. The image bearing member according to claim 1, wherein said filling-up member comprises an inclining surface with a length of at least 1 mm, where said inclining surface has a continuous or stepwise shaped taper from said outer peripheral surface of said filling-up member towards at least said first end face of said filling-up member.

4. The image bearing member according to claim 1, wherein said clearance formed between said inner peripheral surface of said cylindrical member and said outer peripheral surface of said filling-up member is between 50 $\mu$m and 100 $\mu$m.

5. The image bearing member according to claim 4, wherein a viscosity of said anaerobic adhesive is between 10 cp and 100 cp.

6. The image bearing member according to claim 1, wherein a viscosity of said anaerobic adhesive is between 200 cp and 300 cp.

7. The image bearing member according to claim 1, wherein said adhesive extends substantially around an entire periphery of said outer peripheral surface of said filling-up member, and said adhesive extends over an adhesion width.

8. An image forming apparatus for forming an image comprising:

an image bearing member including a cylindrical member, on a peripheral surface of which an image is to be formed;

said image bearing member including a filling-up member mounted with a clearance to an inner part of said cylindrical member for suppressing vibration of said cylindrical member;

said image bearing member also including an anaerobic adhesive having a viscosity between 10 cp and 400 cp, and which adheres to and fixes an outer peripheral surface of said filling-up member to an inner peripheral surface of said cylindrical member, wherein said clearance is between 50 $\mu$m and 200 $\mu$m and is configured such that the adhesive diffuses in said clearance through osmosis;

a charging device for charging said image bearing member;

an exposing device for forming an electrostatic latent image by exposing said image bearing member charged by said charging device;

a developing device for developing said latent image formed by said exposing device.

9. The image forming apparatus according to claim 8, wherein said charging device is a charging roller for charging said image bearing member, and contacts said cylindrical member which composes said image bearing member.

10. An image bearing member to be utilized in an image forming apparatus comprising:

a cylindrical member on which an image is to be formed on a peripheral surface thereof;

a filling-up member mounted with a clearance to an inner part of said cylindrical member for suppressing vibration of said cylindrical member;

an inclining surface which has a tapered shape from an outer peripheral surface of the filling-up member towards at least one end face in a continuous or stepwise shaped taper; and, an anaerobic adhesive having a viscosity between 10 cp and 400 cp and which adheres to and fixes an outer peripheral surface of said filling-up member to an inner peripheral surface of said cylindrical member, wherein said clearance is between 50 $\mu$m and 200 $\mu$m and which is configured such that the adhesive is able to diffuse therein, and wherein said anaerobic adhesive forms an adhesive surface extending substantially around said outer peripheral surface of said filling-up member.

11. The image bearing member according to claim 10, wherein a degree of an angle of said inclining surface is between 10 and 80 degrees.

12. The image bearing member according to claim 10, wherein a length of said inclining surface measured along a longitudinal axis of said filling-up member is at least 1 mm.

13. A method of manufacturing an image bearing member for an image forming apparatus, comprising the steps of:

vertically positioning a filling-up member inside a cylindrical member with a predetermined clearance between an inner peripheral surface of said cylindrical member and an outer peripheral surface of said filling-up member;

injecting an anaerobic adhesive into said clearance from above an end of said filling-up member, wherein the predetermined clearance is sized to allow the anaerobic adhesive to diffuse into the clearance through osmosis;

hardening said anaerobic adhesive after said anaerobic adhesive has osmosed into said clearance;

wherein said clearance formed between said inner peripheral surface of said cylindrical member and said outer peripheral surface of said filling-up member is between 50 μm and 200 μm, and wherein a viscosity of anaerobic adhesive is between 10 cp and 400 cp.

14. The method as recited in claim 13, wherein said hardening step further comprises hardening said anaerobic adhesive after said anaerobic adhesive has spread substantially around a periphery of said outer surface of said filling-up member, and after said adhesive has formed an adhesion width.

15. The method as recited in claim 13, wherein said clearance formed between said inner peripheral surface of said cylindrical member and said outer peripheral surface of said filling-up member is between 50 μm and 100 μm, and a viscosity of said anaerobic adhesive is between 10 cp and 100 cp.

16. The method as recited in claim 13, wherein said clearance formed between said inner peripheral surface of said cylindrical member and said outer peripheral surface of said filling-up member is between 150 μm and 200 μm, and a viscosity of said anaerobic adhesive is between 200 cp and 300 cp.

17. The method as recited in claim 13, wherein said clearance formed between said inner peripheral surface of said cylindrical member and said outer peripheral surface of said filling-up member is between 50 μm and 200 μm, and a viscosity of said anaerobic adhesive is between 100 cp and 200 cp.

18. The method as recited in claim 13, further comprising the step of sealing a nitrogen gas into an inner part of said cylindrical member after said anaerobic adhesive is osmosed into said clearance.

19. The method as recited in claim 13, further comprising the step of leading said anaerobic adhesive on an end face of said first end of said filling-up member towards said clearance by pressing and spreading.

20. The method as recited in claim 8, further comprising the step of hardening an excess amount of anaerobic adhesive left on an end face of said first end of said filling-up member after said adhesive is osmosed into said clearance, with a lid.

21. The method as recited in claim 20, wherein said lid is made of a material whose surface has releasability to said anaerobic adhesive.

22. The method as recited in claim 20, wherein said lid is coated with a substance including one of a fluorine-containing compound and a fluorine-containing substance.

23. The method as recited in claim 13, further comprising the step of applying a hardening agent to said outer peripheral surface of said filling-up member wherein said hardening agent promotes hardening of said anaerobic adhesive.

24. The method as recited in claim 13 wherein said anaerobic adhesive is made of a material that can be hardened by exposure to ultraviolet rays.

25. The method as recited in claim 13, further comprising the step of hardening said adhesive by radiating ultraviolet-rays.

26. A method of manufacturing an image bearing member for an image forming apparatus, comprising the steps of:

vertically positioning a filling-up member inside a cylindrical member with a predetermined clearance between an inner peripheral surface of said cylindrical member and an outer peripheral surface of said filling-up member;

injecting an anaerobic adhesive into said clearance from above an end of said filling-up member wherein said adhesive is guided in said clearance by an inclining surface formed on said first end of said filling-up member between said outer peripheral surface of said filling-up member towards an end face wherein said inclining surface has a continuous or stepwise tapered shape, wherein the predetermined clearance is sized to allow the anaerobic adhesive to diffuse into the clearance through osmosis; and hardening said anaerobic adhesive after said anaerobic adhesive has diffused into said clearance;

wherein said clearance formed between said inner peripheral surface of said cylindrical member and said outer peripheral surface of said filling-up member is between 50 μm and 250 μm, and a viscosity of said anaerobic adhesive is between 10 cp and 400 cp.

* * * * *